United States Patent [19]

Brotherston

[11] 4,455,126

[45] Jun. 19, 1984

[54] FUEL PUMPING APPARATUS

[75] Inventor: Colin P. Brotherston, Rainham, England

[73] Assignee: Lucas Industries plc, Birmingham, England

[21] Appl. No.: 368,152

[22] Filed: Apr. 14, 1982

[30] Foreign Application Priority Data

Apr. 23, 1981 [GB] United Kingdom ..... 8112549

[51] Int. Cl.[3] ..... F04B 19/02; F04B 23/12

[52] U.S. Cl. ..... 417/252; 417/435; 417/462

[58] Field of Search ..... 417/252, 462, 435

[56] References Cited

U.S. PATENT DOCUMENTS

| | | | |
|---|---|---|---|
| 3,363,568 | 1/1968 | Evans | 417/252 X |
| 3,970,414 | 7/1976 | Mowbry | 417/252 |
| 4,292,012 | 9/1981 | Brotherston | 417/462 X |
| 4,309,151 | 1/1982 | Craven | 417/462 |
| 4,382,751 | 5/1983 | Potter | 417/252 X |

FOREIGN PATENT DOCUMENTS 2037365 7/1980 United Kingdom .

*Primary Examiner*—Richard E. Gluck

[57] ABSTRACT

A fuel pumping apparatus for supplying fuel to a compression ignition engine includes a low pressure pump having an outlet connected to an air/fuel separation chamber. The chamber is connected to a high pressure pump through a passage. Fuel is supplied to an inlet of the low pressure pump through a first passage formed in a rotary part of the apparatus, the passage extending into a cavity in the apparatus. A fuel supply passage connects with the cavity and a second passage connects the upper part of the cavity with the fuel inlet of the low pressure pump. The second passage incorporates a non-return valve. Air in the cavity is directed by vortex action to the first passage and can be drawn into the low pressure pump and expelled from the separation chamber through a restricted outlet. If too much air collects in the cavity air will be supplied to the high pressure pump and will cause irregular operation of the engine. The fuel in the cavity when the apparatus is halted covers the entrance of the first passage to allow a restricted flow of fuel to the engine to assist priming of the apparatus.

4 Claims, 2 Drawing Figures

FUEL PUMPING APPARATUS

This invention relates to a fuel pumping apparatus for supplying fuel to a compression ignition engine and of the kind comprising an injection pump mounted within a body part of the apparatus, said body part defining a cavity, a drive shaft extending into said cavity and means coupling said shaft to a rotary part of said injection pump, a low pressure supply pump having a fuel inlet for supplying fuel at low pressure to the injection pump and a relief valve for controlling the output pressure of the supply pump.

Engines to which fuel is supplied by such apparatus are now being utilized to propel automobiles whereas in the past they have been used mainly for commercial vehicles. In an effort to reduce the cost of the engine and its equipment, the aforesaid low pressure pump is being utilized to draw fuel from the vehicle fuel tank whereas in the past it has been the practice to provide an engine operated lift pump of the diaphragm type to supply the fuel to the inlet of the low pressure pump. The lift pump is often supplied with a hand priming lever so that in the event that air enters the system as for example if the tank is allowed to run dry, it is a comparatively easy matter to ensure that fuel is present at the fuel inlet of the low pressure pump before attempting to start the engine. Even if such a priming lever is not supplied the displacement of the diaphragm pump being high, ensures that fuel is supplied to the fuel inlet fairly quickly upon cranking the engine.

The displacement of the low pressure supply pump whilst being higher than that of the injection pump is not sufficiently high to ensure that fuel is drawn quickly from the fuel tank whilst cranking the engine. It is inconvenient to increase the size of the low pressure pump because this would require an increase in the overall size of the apparatus and also there would be an increased power loss. As a result when cranking the engine for the purpose of priming the system an excessive strain is placed upon the starting motor and upon the storage accumulator. The object of the invention is to provide an apparatus of the kind specified in an improved form.

According to the invention in an apparatus of the kind specified the fuel inlet for said low pressure pump is connected to said cavity by way of a path which includes a passage formed in said drive shaft or some other rotary part of the apparatus and the apparatus includes a fuel inlet connection opening into said cavity for connection in use to a fuel tank, the arrangement being such that air entering the cavity will be drawn by vortex action to the entrance of said passage, the air being drawn into the low pressure supply pump to impede the flow of fuel to the injection pump.

An example of a fuel pumping apparatus in accordance with the invention will now be described with reference to the accompanying drawings in which.

Figure 1:
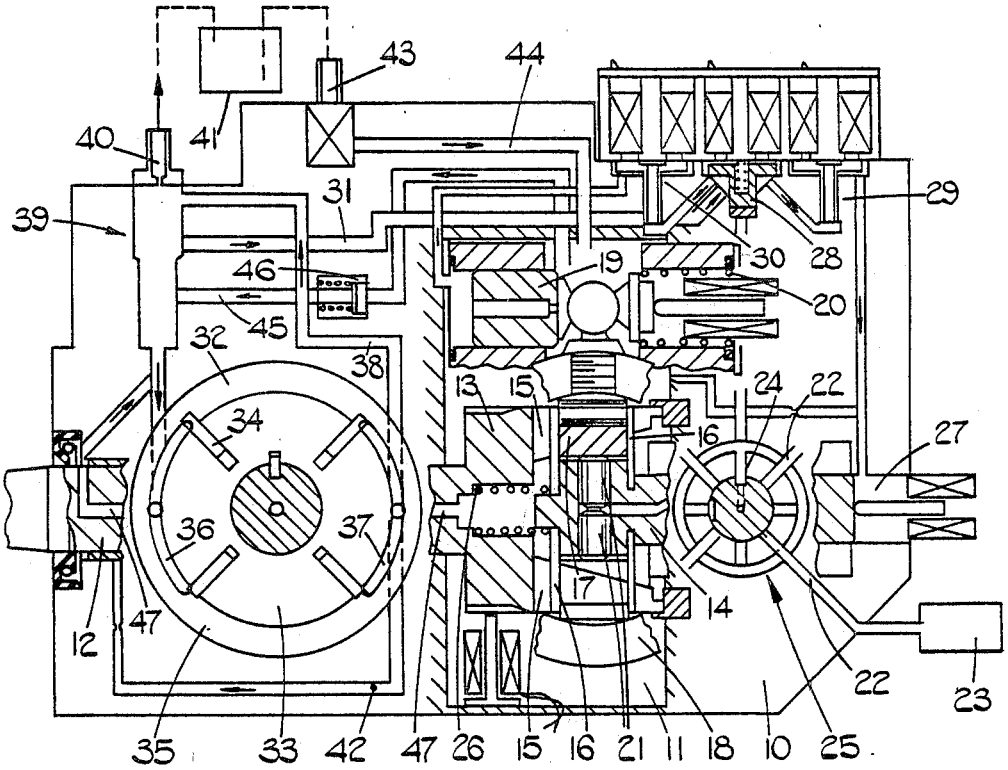
FIG. 1 is a diagrammatic view of the apparatus.

Referring to the drawing the apparatus comprises a body 10 in which is defined a cavity 11. Extending into the cavity from one end of the body is a drive shaft 12 which in use, is connected to a rotary part of the engine so as to be driven thereby.

The drive shaft terminates in a head 13 located within the aforesaid cavity and the head extends to enclose a part of a distributor member 14 which is rotatable within the body. Formed in the head are a pair of slots 15 and the distributor member is driven in synchronism with the drive shaft by means of a pair of plates 16 secured to the distributor member and having portions which extend into the slots 15. Also slidable in the slots is a pair of cam followers 17 respectively which at outer ends engage the internal peripheral surface of a cam ring 18 (a portion of which is shown in end elevation). The cam ring is angularly movable about the axis of rotation of the distributor member by means of a piston 19 which is contained within a cylinder to which liquid of varying pressure can be supplied. The piston 19 effects movement of the cam ring against the action of the spring 20.

At their inner ends the cam followers 17 engage a pair of plungers 21 which are slidably mounted in a transverse bore in the distributor member 14. Communicating with the bore is a longitudinal passage which can be connected in turn to outlet ports 22 which in use, are connected to the injection nozzles 23 of the associated engine. The passage can also be brought into register with an inlet 24 which is connected to a source of fuel under pressure which will be described. The connection of the passage to the outlets and inlets is controlled by valve means which is generally indicated at 25 and which is well known in the distributor pump art.

The quantity of fuel which is delivered to the engine is controlled in the particular example, by controlling the extent of outward movement of the plungers 21, this being effected by varying the axial position of the distributor member 14. The cam followers 17 have shaped surfaces for engagement with a complementary surface formed on the internal peripheral surface of the head 13 whereby alteration of the axial setting of the distributor member varies the extent of allowed outward movement of the plungers. The distributor member is biassed in one direction by means of a spring 26 and in the opposite direction by fluid under pressure which is supplied to a chamber 27. A more detailed description of this form of pumping appartus is to be found in U.S. Pat. No. 4,292,012. It will be appreciated that the valve arrangement 25 is also shown in end elevation.

Fuel is supplied to inlets 24 by way of an electro-magnetic controlled valve 28. A further valve 29 is provided to control the pressure within the cylinder 27 and a still further valve 30 is provided to control the pressure in the cylinder which contains the piston 19. The apparatus also includes two transducers for providing signals indicative of the axial position of the distributor member 14 and also the piston 19 and an additional transducer is providing which senses markings on the periphery of the head 13. The signals from the transducers are supplied to an electronic control circuit which controls the operation of the valves 28, 29, and 30. Fuel is supplied to the valves by way of a passage 31 and the fuel is supplied by a low pressure supply pump generally indicated at 32. The supply pump includes a rotor 33 which is carried upon the drive shaft 12 and which mounts vanes 34 which co-operate with an eccentrically disposed internal surface on a stator portion 35 of the pump. The pump includes an inlet segment 36 and an outlet segment 37. It will be appreciated that in the drawing the parts of the low pressure pump are shown in side elevation.

The outlet segment 37 is connected by means of a passage 38 to a chamber 39 defined in the body. From the upper end of the chamber extends a restricted outlet 40 which is connected back to a vented fuel supply tank 41. The passage 31 extends from a lower portion of the chamber 39 and the arrangement is such that small bubbles of air which are contained in the fuel drawn from the tank and which pass through the low pressure pump, are returned to the tank, the chamber 39 acting as an air separator. Air and also fuel/air emulsion can easily flow through the the restricted outlet 40 the flow of fuel on its own, however, is at a much lower rate. Fuel under pressure is also supplied by way of a passage 42 to the bearing of the drive shaft 12.

The apparatus is provided with a liquid fuel inlet 43 which in use, is connected to the tank 41 possibly by way of external filters not shown. The inlet 43 is connected by way of a passage 44 to the upper portion of the cavity 11.

The inlet segment 36 of the low pressure pump 32 is connected to the lower portion of the chamber 39, the lower portion being of smaller diameter than the upper portion. Moreover, opening into the lower portion of the chamber is a passage 45 which extends from the upper portion of the cavity 11 and which includes a non-return valve 46 disposed to permit fuel flow from the cavity to the inlet pump segment of the pump. An additional connection to the cavity is provided by an axial drilling 47 in the drive shaft and which opens into the chamber defined in the head 13 and which accommodates the spring 26. The other end of the drilling is connected to a space extending around the drive shaft and located between the end of the bearing and an oil seal. The chamber 39 includes a relief valve seen in FIG. 2, which operates to control the output pressure of the pump 32. This is accomplished by allowing fuel to flow from the upper to the lower portion of the chamber 39 so that fuel is returned to the inlet segment.

In operation, the cavity 11 is normally full of fuel and any air bubbles contained in the fuel will by vortex action owing to the rotation of the head 13, accumulate in the chamber which accommodates the spring 26. This air will be drawn through the pump 32, separated in the chamber 39 and will flow back to the tank 41. Such small quantities of air are common and are adequately dealt with by the separator. The passage 47 offers a restriction to the flow of fuel as compared with the valve 46 so that the pressure drop across the valve 46 will be less than that between the ends of the passage 47, and so the majority of the fuel flowing to the low pressure pump will flow by way of the passage 45. If large quantities of air are drawn into the cavity it may flow directly through the passage 45, but in any event a substantial amount of air by virtue of the vortex action will accumulate in the chamber 26 and will flow to the inlet segment of the pump. The air will tend to flow along the passage 47 in preference to the flow of fuel along the passage 45 because the passage 47 will offer a lower restriction to the flow of air than the valve 46 and hence it can be expected that the valve 46 will close. The supply pump now receives comparatively large quantities of air which pass through the pump and collect in the chamber 39. The restricted outlet 40 from this chamber is arranged so that it is unable to cope with large quantities of air and hence some air flows along the passage 31 to the high pressure pump constituted by the plungers 21. This flow of air will cause erratic operation of the engine which should provide a signal to the driver that something is at fault. Assuming that he stops the engine then the fuel and air in the cavity 11 will separate so that the end of the passage 45 is exposed to the air in the cavity 11 whilst the end of the passage 47 is covered with fuel. If now the tank is replenished with fuel and the engine started, the flow of fuel through the passage 47 will be sufficient to permit operation of the engine at low speed and fuel will be drawn into the cavity by way of the passage 44. If during the priming process the operator tries to increase the speed of the engine then it can be expected that the valve 46 will open and allow a large quantity of air to flow to the inlet segment 36. Once again the engine will operate in an erratic manner providing an indication to the operator that the priming process has not yet been completed. The air which is drawn into the cavity 11 must flow through the low pressure pump but whilst it is doing this some of the air is flowing by way of the outlet 40 to the tank. Gradually the air in the cavity will be displaced to the tank.

Figure 2:
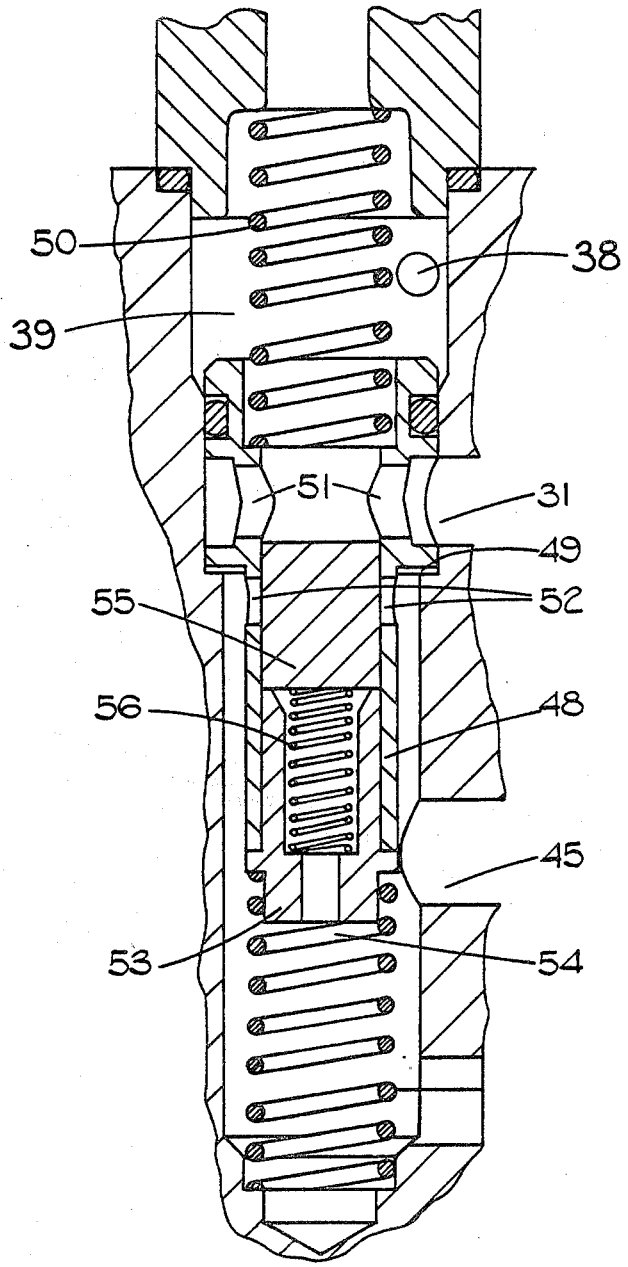
FIG. 2 is a sectional view of part of the apparatus of FIG. 1.

The relief valve is seen in detail in FIG. 2 and it comprises a tubular flanged member 48 which is located against a step 49 defined in a bore forming the lower part of the chamber 39. A spring 50 serves to retain the flanged portion of the member against the step. The flanged portion defines ports 51 which communicate with the passage 31 and beneath the flanged portion the member 48 is provided with ports 52 which communicate by way of an annular clearance, with the passage 45. Extending into and slidable within the lower end of the tubular member 48 is a further flanged member 53 which is biased upwardly by means of a regulating spring 54. Moreover, slidable within the tubular member 48 is a plunger 55 which is engageable with the member 53 but which can be moved relative thereto by a light spring 56.

When the apparatus is at rest the plunger 55, under the action of the spring 56 covers the ports 51 and thereby blocks the communication of the passage 31 with the lower portion of the chamber 39. As the engine is cranked for starting purposes it is only after a predetermined pressure e.g. 5 P.S.I. has been built up in the chamber 39 that the plunger 55 is moved against the action of the spring 56 to uncover the ports 51 to allow fuel flow to the various electro-magnetic valves and hence to the injection pump. The regulating action of the valve occurs when the force produced by the pressure acting on the plunger 55 is sufficient to overcome the force exerted by the spring 54. When this occurs the plunger and tubular member 53 move downwardly to uncover the ports 52 and thereby allow fuel to flow from the chamber 39 to the inlet 36 of the pump 32.

I claim:

1. A fuel pumping apparatus for supplying fuel to a compression ignition engine comprising a body part and an injection pump mounted therein, a cavity defined by the body part, a drive shaft extending into said cavity, means coupling the drive shaft to a rotary part of the injection pump, a low pressure supply pump for supplying fuel at low pressure to the injection pump, a fuel inlet to the low pressure supply pump, a relief valve for controlling the output pressure of the supply pump, characterized in that the fuel inlet for said low pressure pump is connected to said cavity by way of a path which includes a passage formed in said drive shaft and the apparatus includes a fuel inlet connection opening into said cavity for connection in use to a fuel tank, the arrangement being such that air entering the cavity will be drawn by vortex action to the entrance of said passage, the air being drawn into the low pressure supply pump to impede the flow of fuel to the injection pump.

2. An apparatus according to claim 1, including a further passage connecting said fuel inlet to said cavity, said further path including a non-return valve positioned to allow fuel flow to the fuel inlet, said further passage opening into said cavity at a position which in use, will be above the point of entry of said first-mentioned passage into said cavity.

3. An apparatus according to claim 2, including an air/fuel separation chamber in said body part, said chamber being positioned so that the fuel delivered by the low pressure pump flows therethrough, and a restricted outlet from the upper part of said separation chamber to allow air retained in said chamber to flow to the exterior of the apparatus.

4. An apparatus according to claim 1, in which said passage opens into a chamber formed in said drive shaft.

* * * * *